US006289976B1

(12) United States Patent
Larinoff

(10) Patent No.: US 6,289,976 B1
(45) Date of Patent: Sep. 18, 2001

(54) AIR-COOLED VACUUM STEAM CONDENSER BUNDLE ISOLATION

(76) Inventor: Michael W. Larinoff, 370 Holly Hill Rd., Oldsmar, FL (US) 34677

( * ) Notice: Subject to any disclaimer, the term of this patent is extended or adjusted under 35 U.S.C. 154(b) by 0 days.

(21) Appl. No.: 09/285,965

(22) Filed: Apr. 5, 1999

(51) Int. Cl.[7] ..... F28B 3/00
(52) U.S. Cl. ..... 165/113; 165/111; 165/917
(58) Field of Search ..... 165/110, 111, 165/112, 113, 114, 917

(56) References Cited

U.S. PATENT DOCUMENTS 5,113,933 * 5/1992 Larinoff ..... 165/917 X

* cited by examiner

*Primary Examiner*—Christopher Atkinson

(57) ABSTRACT

For multi-cell, mechanical draft, vacuum steam condensers, a design of a noncondensible gas removal system that isolates bundles and fan cells from external/internal influences and gas/vapor interchange and allows bundles to operate in a reverse air-flow direction, all of which promotes freeze protection and improved performance.

19 Claims, 9 Drawing Sheets

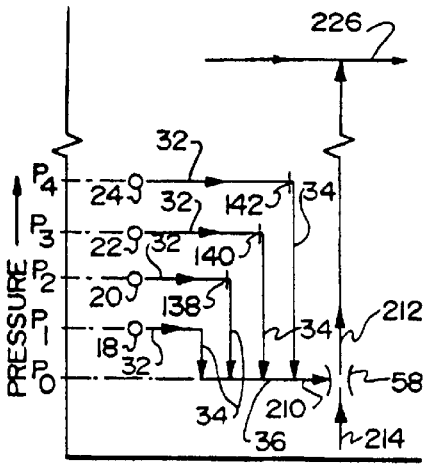
FIG. 5
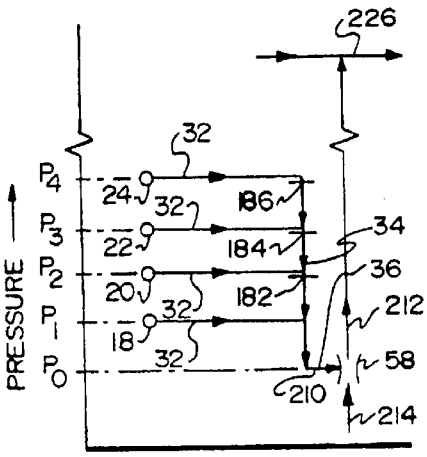
FIG. 6
FIG. 7
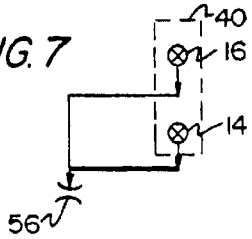
FIG. 8
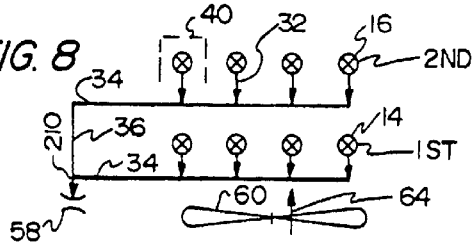
FIG. 9
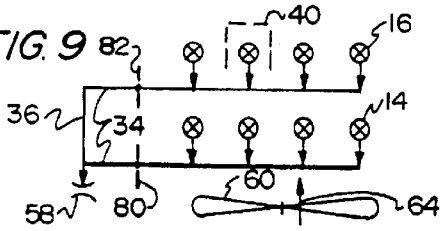
FIG. 10
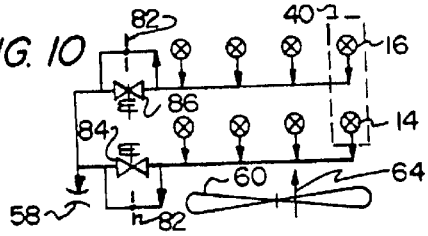

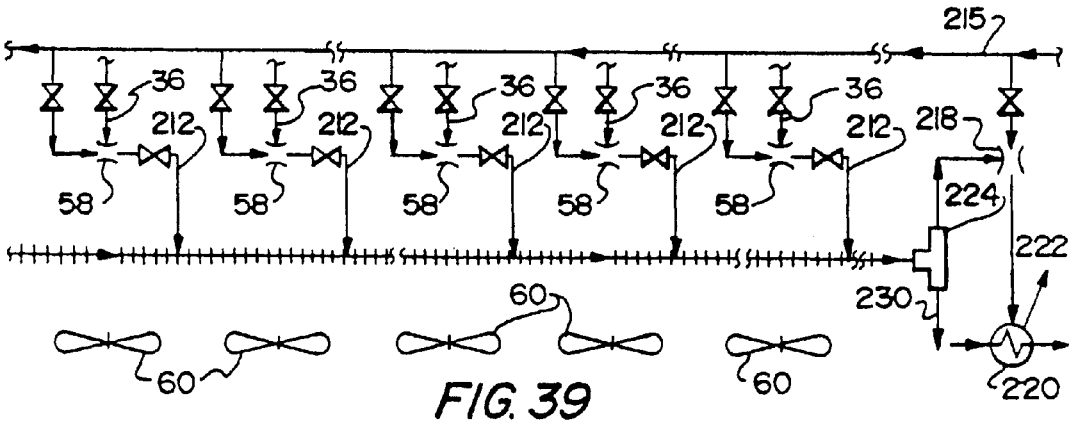
FIG. 39
FIG. 40
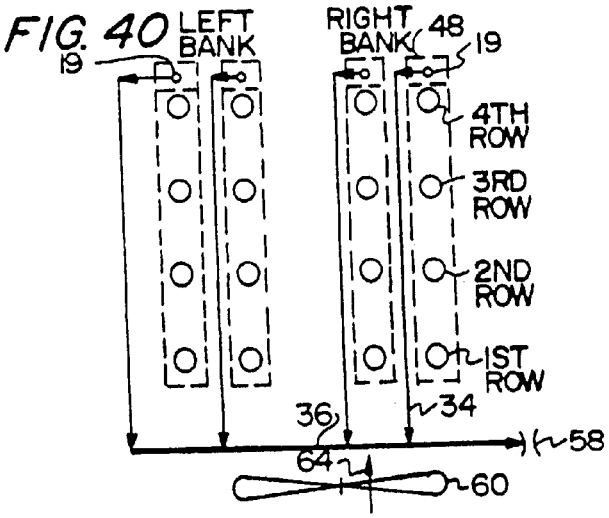

AIR-COOLED VACUUM STEAM CONDENSER BUNDLE ISOLATION

BACKGROUND OF THE INVENTION

1. Summary of the Invention

This invention relates to air-cooled vacuum steam condensers and the isolation of noncondensible gas removal from tube rows, bundles and fan cells by the use of orifices and steam nozzles that isolate the operation of bundles and individual fan cells thereby promoting freeze protection and allowing reverse ambient air flow through the bundles by reversing fan motor rotation that creates a desired protective hot-air recirculation environment.

2. Description of the Background Art

Various air-cooled vacuum steam condensers are disclosed in the patent literature which feature many variations of heat-exchange bundle designs. Few extend their invention into that portion of the steam condensing system that starts with the bundle rear headers and terminates with the gas/air removal equipment. Without exception, they all show an evacuation piping system that connects the bundle rear headers direct to a common manifold. This manifold pipe then leads to the gas/air removal equipment commonly known as the Steam-Jet-Air-Ejector (SJAE). Air-cooled steam condenser patents featuring this direct connected common manifold evacuation system for their bundle rear headers are disclosed in the patent literature.

Typical of overall air-cooled vacuum systems of this type are those disclosed in my recent patents, U.S. Pat. Nos. 4,903,491; 4,905,474 and 4,926,931, the subject matter of which is incorporated herein by reference. Other air-cooled vacuum systems, or at least parts thereof, are disclosed in my earlier U.S. Pat. Nos. 3,968,834; 4,129,180; 4,518,035; and in particular U.S. Pat. No. 5,113,933. Patents disclosing full air-cooled vacuum systems, or at least significant parts thereof, include U.S. Pat. Nos. 2,217,410 and 2,247,056 to Howard; 3,289,742 to Niemann; 4,168,742 to Kluppel; 4,190,102 to Gerz and 4,417,619 to Minami. Lastly, portions of air-cooled vacuum systems which do not disclose the specifics of the full recirculation of the steam and the movement of the non-condensible gasses include U.S. Pat. Nos. 3,543,843 to Gunter; 3,556,204 to Dehne; 3,677,338 to Staub; 3,705,621 to Schoonman; 3,707,185 to Modine as well as U.S. Pat. No. 3,887,002 to Schulman.

In addition, the object of this invention is to improve the freeze protection features of known air-cooled vacuum steam condensers by a new design of noncondensible gas manifolding and removal system. The proposed improvements are in that portion of the system which starts at the bundle rear headers and ends with the Steam-Jet-Air-Ejector (SJAE) equipment.

There are many reasons for air-cooled steam condensers freezing such as bundle design, system design, controls, operation and uncontrolled external/internal influences. This condenser improvement deals with the uncontrolled external/internal influences that are the cause of many unexplained tube freezing problems. It presents a relatively simple solution to this complex problem which is applicable to all vacuum steam condensers.

Experience has shown that bundles and tubes of certain fan cells in large steam condenser installations are more prone to freeze than the bundles and tubes of other fan cells in the same condenser. The question that arises is why should this happen when all the steam condensing tubes/bundles/fan cells in a given condenser tower are of identical construction. The simple answer is that every tube/bundle/fan cell is subject to different external/internal influences that affect its thermal performance.

Some of the major external influences that affect the thermal performance of each tube/bundle/fan cell differently are wind effects, natural draft, hot-air recirculation, wind walls, air flow restrictions, structure shielding and clogged fins. For example, some fan cells are protected from cold winds by being located immediately behind a large wind wall while other fan cells are in the direct path of the cold blast.

Internal influences affecting fan cell performances are steam duct length, size, elbows, straightening vanes, steam velocities, tees and valves. For example, some fan cells are located close to the turbine exhaust while others are in the furthest reaches of the structure. The same applies to the noncondensible gas removal equipment (SJAE) and its physical location relative to the far-out fan cell it is serving. Another most important influence concerns differences in mass air flow delivered by a mechanical draft fan as a result of differences in blade profile, pitch setting and motor speed.

All of the factors listed above affect the quantity of steam condensed by each and every tube/bundle/fan cell. This by itself would not be cause for concern if it were not for the fact that because the bundles condense different quantities of steam they have different steam pressure-drops across their tubes. This results in different rear header pressures and this is where the problem lies. Since all of the rear headers are connected to the same noncondensible gas-piping manifold system, there is a backflow exchange of gas/vapor mixtures through this common piping amongst the rear headers. In this backflow process the steam pressures quickly equalize by the formation of stagnant gas pockets of varying lengths inside the steam condensing tubes. The system is self-compensating in this process but it does so at the expense of creating stagnant gas pockets inside the finned tubes. These gas pockets are cold because they lack steam and any condensate flowing through them can freeze. Tube rupture generally follows condensate freezing. When the ambient air temperature is above 32 F., the gas pockets blanket heat transfer surfaces which then lowers the steam condensing capability of the unit.

The uncontrolled external/internal influences affect each tube/bundle/fan cell differently because of their physical location in the condenser installation. An uncontrollable fluid disruption in one corner of the condenser automatically causes a fluid disruption in the remainder of the condenser. Trying to eliminate or neutralize these influences is an impossible task as there are just too many of them. Most are beyond the control of the condenser designer. The approach to this problem is not to try to solve or attack the individual influences but to stop and prevent the backflow interchange of noncondensible gases and vapors amongst the rear headers through their common manifold piping system.

The obvious solution to the problem is to install check valves in the manifold piping system. Fluid backflow in normal piping systems is prevented by the installation of check valves. Unfortunately, check valves cannot be used in the noncondensible gas evacuation system of air-cooled vacuum steam condensers because of the extremely low fluid pressures in the system which sometimes measure a fraction of an inch of mercury. There is no commercially available check valve that could operate under those conditions. To circumvent this problem, an indirect approach is used. Instead of using pipe check valves as in the direct approach, flow devices are selected that perform other necessary functions and also act as one-way valves. Orifices are used primarily to control fluid flow rate but they also act as one-way valves for fluids flowing from a higher pressure to a lower pressure. Steam ejectors are vacuum producing devices but they too act as one-way valves once the suction gases mix with the high pressure motive steam in the nozzle. Hence the devices selected for use in the new noncondensible gas evacuating system are orifices and steam ejectors. The orifices are used to isolate bundle tube rows and the steam ejectors to isolate fan cells. The old concept of connecting all the bundle rear headers directly to a common manifold piping system that leads to the suction side of a large steam ejector is discarded. A common manifold piping system is still used but it cannot backflow the gas/vapors.

The new gas/vapor withdrawal system consisting of orifices discharging to their steam ejector offers three (3) basic degrees of ISOLATION from backflow to the bundles and their fan cell. The greater the isolation, the more costly the design. The highest degree of isolation (No. 1) is obtaining by using a flow control orifice in each row of the bundle with final gas/vapor flow terminating in an individual steam ejector. There is absolutely no backflow amongst the rear headers or bundles of this design. The next highest degree of isolation (No. 2) is the same as No. 1 except that the one steam ejector is shared by the other bundles in that particular fan cell. In this design one of the four bundles may experience an air flow disturbance that would imbalance the gas/vapor flow rate leaving its orifice. There may or may not be any backflow or fluid interchange but there might be a smaller evacuation rate than would be desired. The third degree of isolation (No. 3) has no orifices installed in the individual rear headers. Instead, one orifice is installed in each of the collective tube rows of the group of bundles representing one fan cell. The final gas/vapor discharge is to a steam ejector which serves all the bundles of a single fan cell. In this design there may be some backflow between the same tube row of different bundles but not between different tube rows.

This new rear-end condenser design isolates the bundles and their fan cells such that they become small independent steam condensers. They react to external/internal influences in their own manner without affecting the performance of other bundles or fan cells. The fans can be individually operated to deliver varying quantities of cooling air without upsetting the gas/vapor withdrawal process.

The air flow direction through the bundles can also be reversed without upsetting the gas/vapor withdrawal process inside the bundle rear headers by simply interchanging orifices serving tube row No. 1 with tube row No. 4 and tube row No. 3 and tube row No. 2. This orifice reversal can either be performed manually or automatically with the use of electric solenoid valves. Reverse air flow is accomplished by reversing the fan rotation or changing the fan pitch. Reverse air flow in all or some of the fan cells allows the entire condenser environment to be bathed in warm recirculated air. This type of operation eases the freeze danger to the condenser and surrounding plant equipment.

A new air-cooled intercondenser replacing the conventional water-cooled intercondenser for the Steam-Jet-Air-Ejector (SJAE) set is revealed. Since a piping manifold is required to connect all the steam ejector discharges that are located at each fan cell, it can be made to serve a double purpose. By using finned tubes instead of conventional pipe, the manifold can serve as both a fluid conduit and a heat exchanger to condense the steam inside. This eliminates the need for the conventional costly water-cooled intercondenser.

Accordingly, it is an object of the present invention to provide an improved multi fan-cell system for condensing steam vapors contaminated with air and gases, the system being isolated into single fan cells for the removal and discharge of its noncondensible gas/vapors, each fan cell having one fan and a predetermined number of steam condensing bundles which includes a front header, finned tubes and rear header means whose gas/vapors are extracted and isolated from all other fan cells by a vacuum-producing steam ejector means coupled to the bundle rear headers by pipe and manifold means all located and installed within the confines of the fan cell they serve.

It is a further object of the invention to effectively isolate the output of each rear header pipe and its associated rear header from all other rear header pipes of a different tube row number and their associated rear headers.

It is a further object of the invention to allow reverse air-flow through the bundles by reversing the direction of rotation of fan blades for selected fan cells causing the hot air to be recirculated and discharged downward toward grade elevation thereby raising the ambient air temperature flowing through adjacent fan cells.

It is a further object of the invention to vary the sizes of orifices in pipes from rear headers as a function of the direction of air flow throughout the bundles and rotation of the fans.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

This invention is defined by the appended claims with the specific embodiments shown in the attached drawings. For the purposes of summarizing the invention, the invention may be incorporated into a multi fan-cell system for condensing steam vapors contaminated with air and gases, the system being isolated into single fan cells for the removal and discharge of its noncondensible gas/vapors, each fan cell having one fan and a predetermined number of steam condensing bundles which includes a front header, finned tubes and rear header means whose gas/vapors are extracted and isolated from all other fan cells by a vacuum-producing steam ejector means coupled to the bundle rear headers by pipe and manifold means all located and installed within the confines of the fan cell they serve.

The bundles have a plurality of rear header headers with a plurality of steam pressures that require individual gas/vapor evacuation, and orifice-type restrictions means installed in the pipe and manifold means for the mass flow control of gas/vapors leaving the rear headers and entering the steam ejector and for the isolation of the bundles and tube rows from gas/vapor interchange. The system further includes means for driving the fan in operative association with each cell to force ambient air flow across the finned tubes to thereby condense the steam inside the tubes. The system further includes means to reverse the direction of the air flow through the bundle by reversing the direction of the fan rotation. The system further includes means to reverse the direction of the air flow through the bundle by changing the fan blade pitch. The orifice restriction means may be manually changeable between tube rows thereby allowing the bundles of fan cells to operate with ambient air flow in reverse direction. The restriction means may be automatically changeable to allow the bundles to operate in reverse direction ambient air flow. The restriction means can be changed manually to different sizes between warm weather orifices and cold weather orifices as required to allow proper bundle functioning with reverse direction ambient air flow across all the bundles of a fan cell. The restriction means size changes may be made automatically. One restriction means may serve one rear header or all the rear headers in the fan cell that are of the same tube row number. The restriction means are different size orifice holes to accommodate different steam pressures and different flow rates. The restriction means may be holes drilled in a suction sparger pipe installed inside each rear header. The orifices may be parallel-connected orifices in a first pipe means. The orifices may be parallel-connected orifices installed in a first pipe means plus series-connected orifices installed in primary manifolds. The orifices may be parallel-connected orifices installed in primary manifolds whereby the gas/vapor discharges from rear headers of the same row of tubes are coupled together but different rows of tubes are isolated from each other. The orifices may be series-connected orifices installed in a secondary manifold whereby gas/vapor discharges from the same row of tubes are coupled together but different rows of tubes are isolated from each other. The orifices may be series-connected orifices installed in primary manifolds such that one primary manifold serves one bundle whereby the gas/vapor discharges from the rear headers of any one bundle are isolated from each other.

The invention may also be incorporated into a system for condensing steam vapor and for removing the noncondensible gases therfrom comprising front headers, rear header means and finned tubes therebetween arranged in bundles to form a plurality of fan cells, steam ejector vacuum means installed in each fan cell with its suction inlet coupled to the gas/vapor flows from its associated fan cell bundles and its discharge mixture of motive steam and gas/vapors conveyed through an air-cooled, steam condenseing, finned-pipe, manifold that couples the outputs of all the individual steam ejector vacuum devices into the suction side of a second-stage steam ejector means.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 5 shows gas/vapor pressure drops across parallel orifices installed in each of our rear headers with the final mixture being removed by a steam ejector.

FIG. 6 is the same as FIG. 5 except it has series orifices.

FIG. 7 shows one Sparger Withdrawal bundle with two rear headers and a single steam ejector providing bundle and fan cell isolation.

FIG. 8 shows four Sparger Withdrawal bundles constituting one fan cell with two rear headers each and a single steam ejector providing bundle and fan cell isolation.

FIG. 9 shows how FIG. 8 can be modified to accommodate bundle airflow reversal by manual means.

FIG. 10 shows how FIG. 8 can be modified to accommodate bundle airflow reversal by automatic means.

FIG. 39 shows how FIG. 38 can be modified by substituting an air-cooled pipe-manifold for the conventional pipe manifold thereby eliminating the water-cooled intercondenser.

FIG. 40 shows four direct withdrawal bundles constituting one fan cell where each bundle has only one rear header for gas/vapor evacuation purposes.

Similar reference characters refer to similar parts throughout the several Figures.

DETAILED DESCRIPTION OF THE INVENTION

Figure 1:
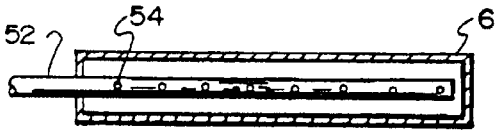
FIG. 1 (PRIOR ART)
FIG. 1 shows a single rear header of a steam condensing bundle with a suction sparger referred to herein as the Sparger Withdrawal design.
Figure 2:
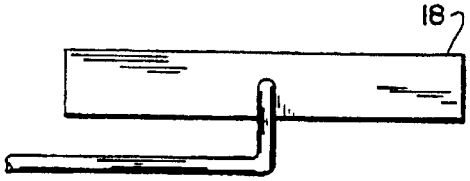
FIG. 2 (PRIOR ART)
FIG. 2 shows a single rear header of a steam condensing bundle with one evacuation pipe referred to herein as the Direct Withdrawal design.
Figure 3:
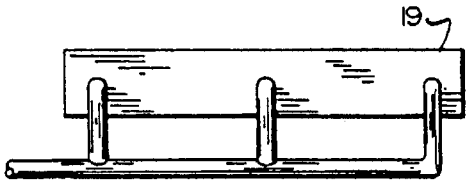
FIG. 3 (PRIOR ART)
FIG. 3 is similar to FIG. 2 except it has three evacuation points connected to one evacuation pipe.

This disclosure applies to all air-cooled steam condensing bundles employing one or more rear headers. The drawings and discussions herein are limited to bundle designs with two and alternatively four rear headers each. Two rear-header bundles are generally employed with large, two-row, oval-shaped, tank-type tubes and they are also used in designs employing four row, two-pass, U-shaped tubes such as U.S. Pat. No. 4,926,931. Four divided rear headers are used in bundles with four tube rows. It will also be assumed that four bundles are served by one fan labeled herein as one fan cell and that the bundles are installed either horizontally or inclined in an A-frame configuration. Normal air movement is shown as forced draft employing motor driven fans. For reasons of simplicity in the presentation of the piping arrangement drawings, FIGS. 5 through 36, the alternative bundle rear header designs FIGS. 1, 2 and 3 are all shown as a circle. These circles in FIGS. 5 through 36 are in essence the single gas evacuation pipe leading from each rear header, FIGS. 1, 2 and 3. This is the starting point for this invention. The clear circles without an X represent FIGS. 2 and 3 rear header gas withdraw designs while those with an X inside the circle indicate a suction sparger gas withdrawal, FIG. 1, which has its own built-in orifices. Alternative tube and bundle designs can have one, two, three, four etc. rear headers. For example, a bundle design with four rear headers is shown in FIGS. 11 through 14 while a bundle with only two rear headers is shown in FIGS. 7 through 10. A bundle design with one rear header is not shown as it would not have any orifices.

There generally are two basic piping designs used by the industry for the withdrawal of noncondensible gases from rear headers 6 and 18 as shown in FIGS. 1 and 2. They differ not only in the manner in which they extract the gas/vapor mixtures from the rear headers but also in their flow characteristics. One basic design FIG. 1 employs a suction sparger pipe 52 with its own built-in orifices 54 that control gas withdrawal along the length of the rear header and control the gas/vapor mass flow leaving the rear header. The suction sparger 52 is the subject of three U.S. Pat. Nos. 4,903,491, 4,905,474 and 4,926,931. The second basic design FIG. 2 is merely a direct pipe-connection to the rear header 18. A variation of this design is FIG. 3 which shows three separated evacuation pipes attached to one rear header 19. Since the fluid flow characteristics of these two basic designs FIGS. 1 and 2 are different, they require different treatment. Henceforth FIG. 1 will be identified in this disclosure as the Sparger Withdrawal design and FIGS. 2 and 3 as the Direct Withdrawal design.

Figure 4:
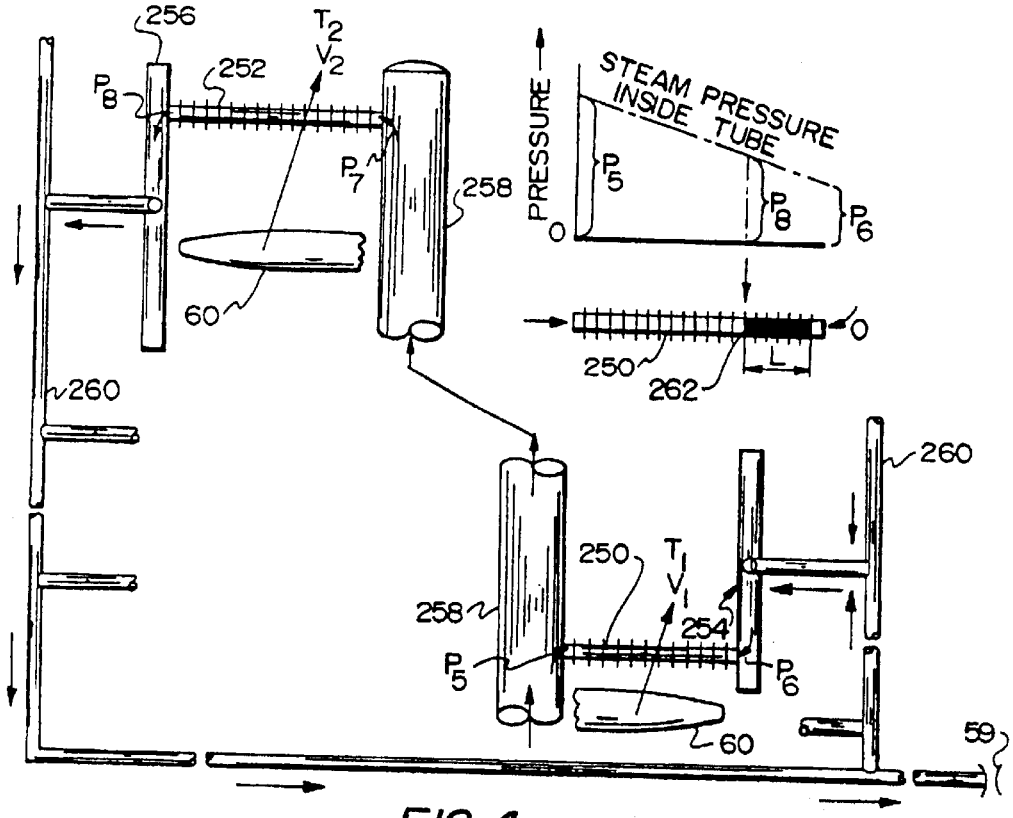
FIG. 4 (PRIOR ART)
FIG. 4 shows how gas pockets are created inside steam condensing tubes as a result of uncontrollable external/internal influences.

FIG. 4 was prepared to show how external and internal influences acting on the condenser's steam condensing bundles can create damaging gas pockets inside the heat-exchange tubes. This is the key problem that this invention addresses. The gas pockets are the result of gas/vapor "backflow" between bundles when employing the typical Direct Withdrawal design of noncondensible gas removal system that connects all the bundle rear headers direct to a common piping manifold that leads to the first stage 7 steam ejector 59 of the steam-jet-air-ejector equipment package 232.

FIG. 4 is an abbreviated drawing of a typical steam condenser showing only two steam-condensing tubes 250, 252 located in two random bundles. The tubes are connected to a common steam supply duct 258 and to their respective rear headers 254, 256. The steam supply pressures P5 and P7 at the entrance to the condensing tubes 250 and 252 are slightly different as a result of duct length, duct size, elbows, tees, straightening vanes and valves. The cooling air velocities V1, V2 and inlet air temperatures T1, T2 are different because of wind effects, natural draft, hot-air recirculation, wind walls, structure shielding, etc. The effect of these external/internal influences is to condense a different quantity of steam in tube 250 compared to tube 252. This means that the steam pressure drop across tube 250 is different than tube 252. As a result of this, the steam pressures P6 and P8 in rear headers 254 and 256 are also different. The rear header steam pressure P6 is simply supply pressure P5 minus the pressure drop across tube 250. If tube 250 is condensing more steam as a result of all these influences, then its rear header 254 pressure P6 is lower than P8 in rear header 256. That being the case, noncondensible gases and vapors will "backflow" through the common manifold piping system 260 into rear header 254. The backflow of gases and vapors will enter the rear of tube 250 where the vapors will condense and the noncondensible gases will be pushed forward. While this is going on the gas pocket continues to grow in length L by the deposit of additional gases fed by steam flow from the front header or supply duct 258. The gas pocket grows in length until its interface 262 reaches steam pressure P8 where it stops, as shown in the pressure diagram drawn above tube 250 in FIG. 4. Both rear headers 250 and 252 are now operating at the same pressure P8 and there is no more backflow into rear header 254. Both bundles are now operating at equilibrium pressures but at the cost of the development of a gas pocket of length L that was created in the rear of tube 250.

If there were no noncondensible gases present in the steam, vapor backflow would not be a problem. The steam vapors would merely enter the rear of tube 250 and condense. Since noncondensible gases are present in the steam then gas pockets are formed and trapped because steam flows into both ends of the condensing tube 250 and the gasses have nowhere to escape. Each time the steam load, ambient temperature and external/internal influences change, old gas pockets are swept away and new ones formed inside the steam condensing tubes throughout the condenser. Some of these pockets are short in length and inconsequential while others are long and potentially dangerous. The gas pockets have no steam so that their metal tube portions are cold and condensate flowing through them can and does freeze.

FIGS. 5 and 6 are the key fluid-flow diagrams for this disclosure and are applicable to all the orifice and piping arrangements shown in these patent drawings. What they portray is basically the essence of this invention. The gas/vapor mixtures discharged from four rear headers of one bundle flow through orifices from their relatively higher pressure levels P4, P3, P2 and P1 to the lowest pressure point P0 in the fan-cell piping manifold system which is the suction side of a steam ejector 58. There is no exception to this flow procedure regardless of steam load, ambient air temperatures, cooling air mass flow or external/internal influences. Once the gas/vapors leave the rear header and pass through the orifices to enter the check valve vacuum producing steam ejector as 210, they are mixed with the usual 150 psig motive steam 214 and discharged at a higher pressure 212 into a common manifold piping system 226 FIG. 38 never to return to rear headers regardless of external/internal influences.

Figure 23:
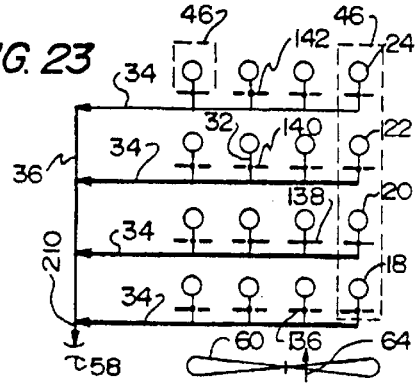
FIG. 23 shows four Direct Withdrawal bundles constituting one fan cell with four rear headers each, parallel orifices and a single steam ejector providing bundle and fan cell isolation.

FIG. 5 shows the relative steam pressures P1, P2, P3, P4 at the rear headers 18, 20, 22, 24 and their pressure drops through parallel flow orifices 138, 140 and 142, reference FIG. 23. The Sparger Withdrawal design reference FIG. 12 has parallel orifices in its suction sparger pipe so that its operation is comparable to FIG. 23 and applicable to FIG. 5. These rear header pressures represent the 1st, 2nd, 3rd and 4th tube rows respectively. The 1st row has the lowest ambient air temperature, condenses the largest quantity of steam, has the highest steam pressure drop through the tubes and therefore has the lowest rear header pressure P1. Similarly the 4th row has the highest ambient air temperature, condenses the least amount of steam, has the smallest steam pressure drop through the tubes and therefore has the highest rear header pressure P4. The gas/vapor discharges from the first row rear header 18 are connected directly to the suction side of steam ejector 58. It has the largest gas/vapor mass flow and the lowest rear header pressure P1 which controls suction pressure P0. Steam pressure P2, P3 and P4 in tube rows 2, 3 and 4, rear headers 20, 22 and 24 are also related to pressure P1 but they are always higher. The orifices 138, 140 and 142 are sized to pass the required gas/vapor mass flow from rear header 20, 22 and 24 at a pressure differential calculated from its gas/vapor pressure to steam ejector 58 suction pressure P0. The high-pressure motive steam 214 passing through the ejector creates a low pressure source P0 that draws the gas/vapor out of the rear headers and discharges the mixture 212 to a higher-pressure level. This discharge pressure level is high enough so that there is never any backflow of gas/vapors to the rear headers from amongst the steam ejectors as a result of external/internal influences and changes in ambient cooling air mass flows.

Figure 33:
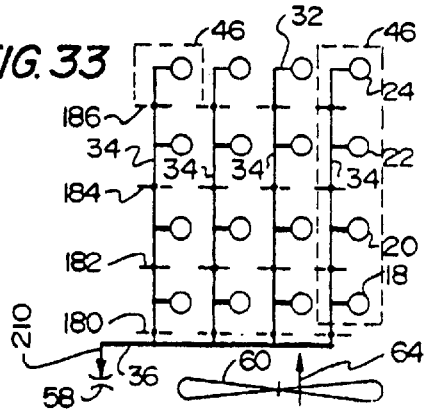
FIG. 33 shows four Direct Withdrawal bundles constituting one fan cell with four rear headers each, series orifices and a single steam ejector providing bundle and fan cell isolation.

FIG. 6 shows the relative steam pressures P1, P2, P3, P4 at the rear headers 18, 20, 22, 24 and their pressure drops through series flow orifices 182, 184 and 186, reference FIG. 33. Compared to parallel orifices these series orifices have lower steam pressure drops but higher mass flows. The total gas/vapor mixture mass entering steam ejector 58 is the same for both the parallel and series orifices.

Figure 37:
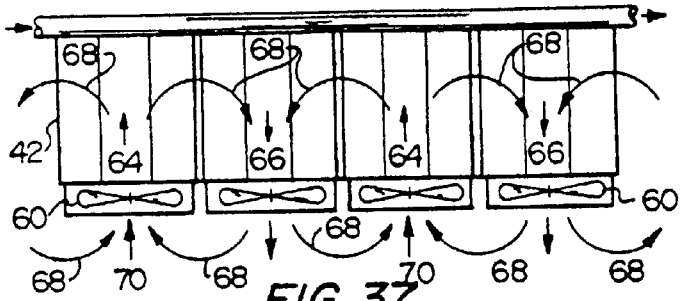
FIG. 37 shows hot-air recirculation amongst fan cells set in an A-frame structure when fan motor direction is reversed in adjacent cells.
Figure 37A:
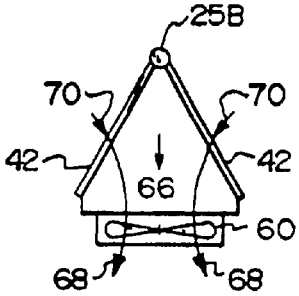
FIG. 37A is a cross section view of FIG. 37 with ambient air flow in reverse direction through the fan cell.

FIGS. 37 and 37A show a typical A-frame steam condenser with some of the fans rotating in reverse direction 66 for added freeze protection. Normal air flow 64 is upward through a forced draft fan 60 and then through the bundles 42. Reversed air flow 66 is downward through the bundles where it is heated then through fan 60 as shown in FIG. 37A. This reverse-air flow literally bathes the entire bottom portion of the condenser structure in warm air 68. This warm air 68 is mixed with some of the cold ambient air 70 and the product is drawn into adjoining fan cells by natural draft with the fan motors turned off. This vast quantity of warm recirculated air lessens the freezing danger for the entire condenser and all the auxiliary equipment located nearby.

Reversing fan rotation is a simple electrical function but preparing the bundles for reverse air flow is another matter. All bundles are designed to operate with cooling air flow in only one direction because of internal steam-flow pressure-drops and gas/vapor removal considerations. What are tube rows 1, 2, 3 and 4 in forward air flow become rows 4, 3, 2 and 1 in reverse air flow where No. 1 is the first row to contact the cold ambient air in forward flow and No. 4 in reverse flow. The bundle, rear header and orifices designs presented herein allow for relatively easy conversion to reverse air flow operation. The methods and means of doing this either manually prior to cold weather or automatically by electrical means is shown in subsequent drawings.

A-Sparger Withdrawal with Parallel Orifices

FIGS. 7, 8, 9 and 10 are the noncondensible gas withdrawal systems for bundles designed with two rear headers 14, 16 employing suction spargers 52 FIG. 1. The first tube-row rear header is 14 and the second is 16. The suction spargers have built-in orifices 54 operating in parallel flow which provide isolation to bundle 40.

FIG. 7 shows one bundle 40 with its individual steam ejector 56. This design represents the highest degree (No. 1) of rear header isolation from gas/vapor backflow. One fan cell would have four such bundles 40 and four such steam ejectors 56.

FIG. 8 shows the second highest (No. 2) form of rear header isolation where the four bundles 40 share the same steam ejector 58. The suction spargers 52 installed in rear headers 14 and 16 are coupled to first pipes 32 that are connected to primary pipe headers 34 which are joined to secondary pipe header 36. The drilled orifices 54 control the gas/vapor mass flow rates existing rear headers 14 and 16. The orifice size and gas/vapor flow rates are different for the two headers 14 and 16.

FIG. 9 shows an alternative design to FIG. 8 for controlling the existing gas/vapor flows. Two orifices 80 and 82 are installed in the primary pipe headers 34 for controlling the mass flow rates instead of orifices 54. The suction sparger orifices 54 are now made larger in diameter and are used only to control the uniformity of gas/vapor extraction along the rear header length. Orifice 80 is a full-bore orifice with no restriction, it is not used if air flow is not reversed.

To allow reverse air flow for warming purposes during cold weather as shown in FIG. 37, orifices 80 and 82 must be manually reversed. When the cold season is over they are again reversed to allow bundle operation with normal air flow.

FIG. 10 is an automated version of FIG. 9. In forward airflow 64 electric solenoid valve 84 is open and 86 closed. In reverse airflow valve 84 is closed and 86 opened.

FIGS. 11, 12, 13 and 14 are comparable to FIGS. 7, 8, 9 and 10 except that they are designs for bundles 42 with four rear headers 6, 8, 10, 14 instead of two.

Figure 11:
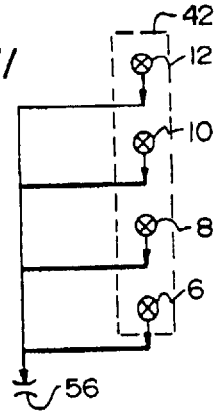
FIG. 11 shows one Sparger Withdrawal bundle with four rear headers and a single steam ejector providing bundle and fan cell isolation.

FIG. 11 shows one bundle 42 with its individual steam ejector 56. This design represents the highest degree (No. 1) of rear header isolation from gas/vapor backflow. One fan cell would have four such bundles 42 and four such steam ejectors 56.

Figure 12:
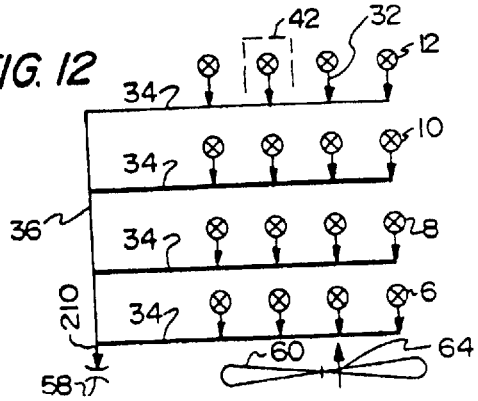
FIG. 12 shows four Sparger Withdrawal bundles constituting one fan cell with four rear headers each and single steam ejector providing bundle and fan cell isolation.

FIG. 12 shows the second highest (No. 2) form of rear header isolation where the four bundles 42 share the same steam ejector 58. The suction spargers 52 installed in rear headers 6, 8, 10 and 12 are coupled to first pipes 32 that are connected to primary pipe headers 34 which are joined to secondary pipe header 36. The drilled orifices 54 control the gas/vapor mass flow rates existing rear headers 6, 8, 10 and 12. The orifice size and gas/vapor flow rates are different for each tube row.

Figure 13:
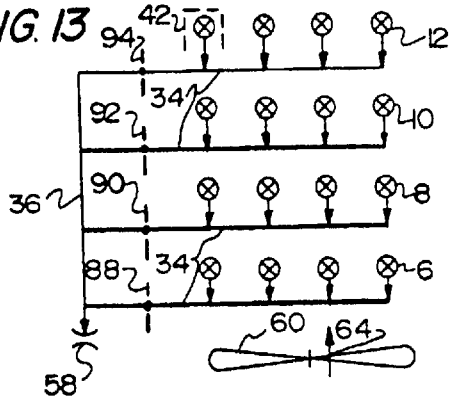
FIG. 13 shows how FIG. 12 can be modified to accommodate bundle airflow reversal by manual means.

FIG. 13 shows an alternative design to FIG. 12 for controlling the existing gas/vapor flows. Four orifices 88, 90 and 94 are installed in the primary headers 34 for controlling the mass flow rates instead of orifices 54. The suction sparger orifices 54 are now made larger in diameter and are used only to control the uniformity of gas/vapor extraction along the rear header length. First row orifice 88 is full bore with no restriction. It is not used if air flow is not reversed.

To allow reverse air flow for warming purposes during cold weather as shown in FIG. 37, orifices 88 and 94 are manually reversed as are orifices 90 and 92. When the cold season is over, they are again reversed to allow operation with normal air flow.

Figure 14:
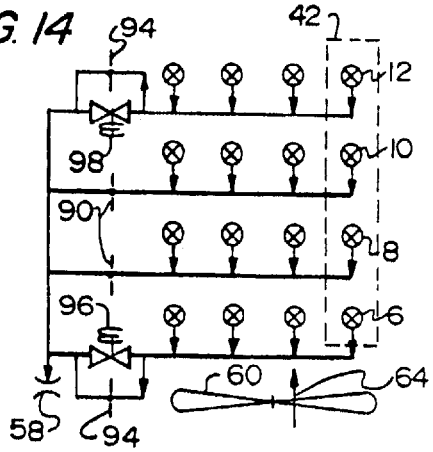
FIG. 14 shows how FIG. 13 can be modified to accommodate bundle airflow reversal by automatic means.

FIG. 14 is the automated version of FIG. 13. In forward airflow electric solenoid valve 96 is open and 98 closed. In reverse airflow valve 96 is closed and 98 open. In this situation the 3rd row from the top is flowing slightly more gas/vapor mixture through orifice 90 than necessary which requires a little more motive steam for the steam ejector. This, however, eliminates the need for automating orifices 90 and 92 and installing instead two identical orifices 90.

B-Direct Withdrawal with Parallel Orifices

FIGS. 15, 16, 17, 18, 19, 20 and 21 are the noncondensible gas withdrawal systems for bundles 44 designed with two rear headers 26, 28 and employing parallel orifices in a Direct Withdrawal design. FIGS. 15, 16, 17 and 18 use orifices to isolate their bundles while FIGS. 19, 20 and 21 have no bundle isolation.

Figure 15:
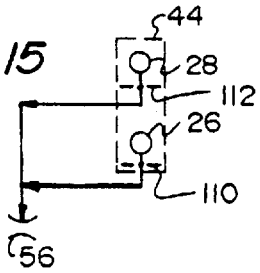
FIG. 15 shows one Direct Withdrawal bundle with two rear headers; parallel orifices and a single steam ejector providing bundle and fan cell isolation.

FIG. 15 shows one bundle 44 with its individual steam ejector 56. This design represents the highest degree (No. 1) of rear header isolation from gas/vapor backflow. One fan cell would have four such bundles 44 and four steam ejectors 56.

Figure 16:
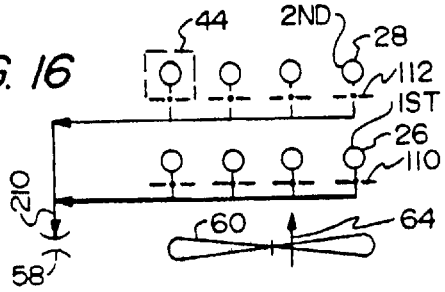
FIG. 16 shows four Direct Withdrawal bundles constituting one fan cell with two rear headers each, parallel orifices and a single steam ejector providing bundle and fan cell isolation.

FIG. 16 shows the second highest (No. 2) form of rear header isolation where the four bundles 44 share the same steam ejector 58. Orifices 112 are smaller than orifices 110.

Figure 17:
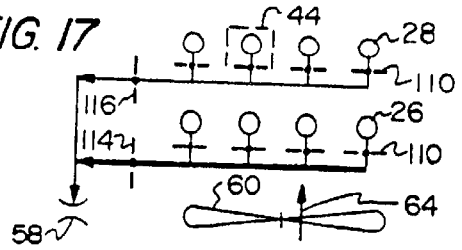
FIG. 17 shows how FIG. 16 can be modified to accommodate bundle airflow reversal by manual means.

FIG. 17 shows how to convert FIG. 16 to allow operation with reverse-cooling airflow 66 through the bundle by the addition of two orifices 114 and 116. All eight of the rear header orifices 110 are the same size. Orifice 114 is a full-bore full-flow size and is not used if air flow is not intended to be reversed. During the cold season orifices 114 and 116 are manually reversed.

Figure 18:
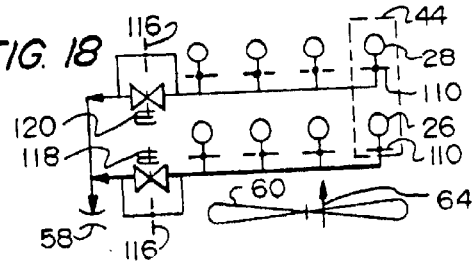
FIG. 18 shows how FIG. 17 can be modified to accommodate bundle airflow reversal by automatic means.

FIG. 18 is the automated version of FIG. 17. In forward airflow 64 electric solenoid valve 118 is open and 120 closed. In reverse airflow valve 118 is closed and 120 open.

Figure 19:
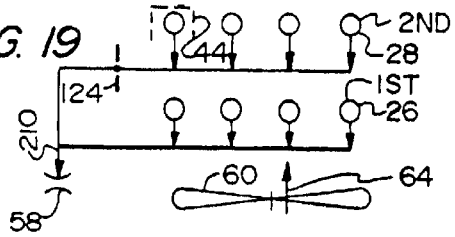
FIG. 19 shows four Direct Withdrawal bundles constituting one fan cell with two rear headers each, parallel manifold orifices and a single steam ejector providing fan cell isolation only.
Figure 20:
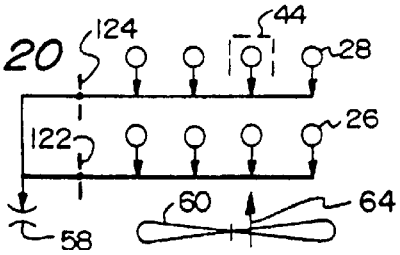
FIG. 20 shows how FIG. 19 can be modified to accommodate bundle airflow reversal by manual means.
Figure 21:
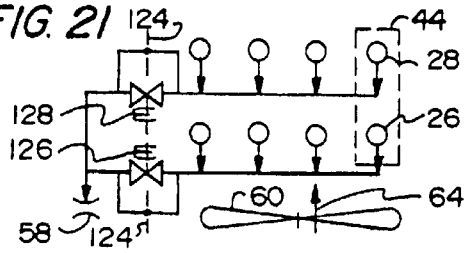
FIG. 21 shows how FIG. 20 can be modified to accommodate bundle airflow reversal by automatic means.

FIGS. 19, 20 and 21 are comparable to FIGS. 16, 17 and 18 except that they do not have individual orifices for each of the rear headers hence they do not provide bundle isolation. FIG. 19 does not require an orifice in the first row. FIG. 20 is designed to allow reverse air flow and it does have an orifice 122 in the first row that is full-bore full-flow size. Orifices 122 and 124 are manually rotated for cold weather operation. FIG. 21 is the automated version of FIG. 20. In forward air flow solenoid valve 126 is open and 128 closed. In reverse air flow valve 126 is closed and 128 open.

FIGS. 22, 23, 24, 25 and 26 are comparable to FIGS. 15, 16, 17, 18, 19, 20 and 21 except that they are designs for bundle 46 with four rear headers 18, 20, 22, 24 instead of two.

Figure 22:
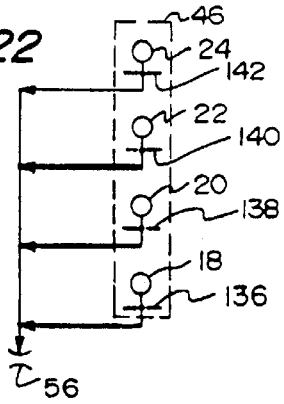
FIG. 22 shows one Direct Withdrawal bundle with four rear headers, parallel orifices and a single steam ejector providing bundle and fan cell isolation.

FIG. 22 shows one bundle 46 with its individual steam ejector 56. This design represents the highest degree (No. 1) of rear header isolation from gas/vapor backflow. All orifices are in parallel fluid flow. One fan cell would have four such bundles 44 and four steam ejectors 56.

FIG. 23 shows the second highest (No. 2) form of rear header isolation where the four bundles 46 share the same steam ejector 58. All rear header orifices of the same tube row are the same size. The orifices are installed in the first pipes 32 that are connected to primary pipe headers 34 which are joined to secondary pipe header 36.

Note that the main difference between FIG. 23 of the Direct Withdrawal design and FIG. 12 of the Sparger Withdrawal design is that FIG. 23 has an external orifice in each pipe line leaving a rear header. FIG. 12 also has an orifice but it is an internal orifice consisting of many smaller orifices drilled in the suction sparger. They both perform an identical function which is to control the gas/vapor flow rate. The suction sparger orifices also scavenge the full length of the rear header thereby performing an additional function.

Figure 24:
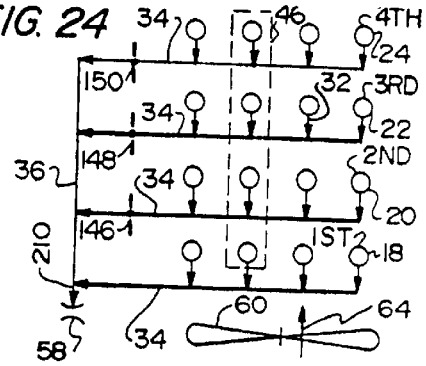
FIGS. 24 and 24A shows four Direct Withdrawal bundles constituting one fan cell with four rear headers each, parallel manifold orifices and a single steam ejector providing fan cell isolation only.
Figure 25:
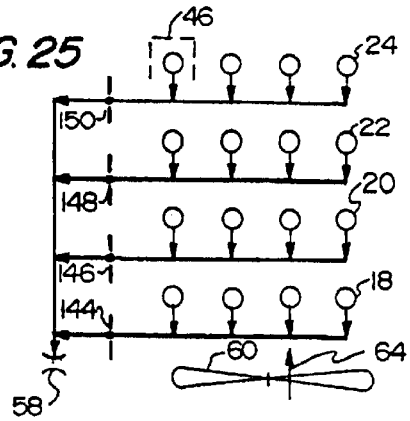
FIG. 25 shows how FIG. 24 can be modified to accommodate bundle airflow reversal by manual means.
Figure 26:
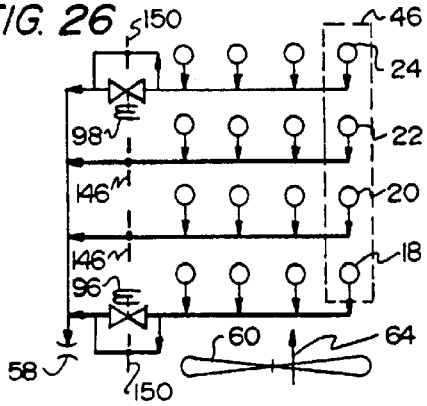
FIG. 26 shows how FIG. 25 can be modified to accommodate bundle airflow reversal by automatic means.

FIGS. 24, 25 and 26 do not provide bundle isolation, only fan cell isolation. Orifices 144, 146, 148 and 150 serve the 1st, 2nd, 3rd, 4th tube rows respectively. FIG. 24 has permanently installed orifices that are not intended to be rotated hence first now orifice 144 is not required. FIG. 25 has manually reversible orifices that are rotated for cold weather operation. Prior to cold weather, orifices 144 and 150 are rotated as are orifices 146 and 148. FIG. 26 is the automated version of FIG. 25. In forward air flow solenoid valve 96 is open and 98 closed. In reverse airflow valve 96 is closed and 98 open.

C-Direct Withdrawal with Series Orifices

Figure 27:
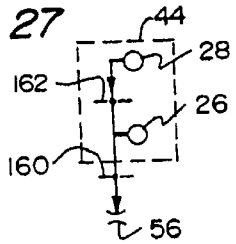
FIG. 27 shows one Direct Withdrawal bundle with two rear headers, series orifices and a single steam ejector providing bundle and fan cell isolation.
Figure 28:
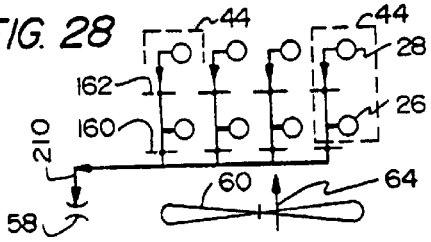
FIG. 28 shows four Direct Withdrawal bundles constituting one fan cell with two rear headers each, series orifices and a single steam ejector providing bundle and fan cell isolation.

FIGS. 27, 28, 29, 30 and 31 are the noncondensible gas withdrawal systems for bundles 44 designed with two rear headers 26, 28 and employing series flow orifices in a Direct Withdrawal design. FIGS. 27 and 28 use orifices to isolate their bundles while FIGS. 29, 30 and 31 have no bundle isolation.

FIG. 28 shows one bundle 44 with its individual steam ejector 56. This design represents the highest degree (No. 1) of rear header isolation from gas/vapor backflow. One fan cell would have four such bundles 44 and four steam ejectors 56.

Figure 29:
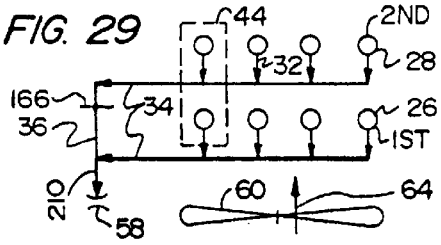
FIG. 29 shows four Direct Withdrawal bundles constituting one fan cell with two rear headers each, series manifold orifices and a single steam ejector providing fan cell isolation only.

FIG. 29 shows the second highest (No. 2) form of rear header isolation where the four bundles 44 share the same steam ejector 58. All rear header orifices of the same tube row are the same size. The rear headers are connected to first pipes 32 that are coupled to primary headers 34 which rejoined to secondary header 36 that has orifice 164 installed therein.

Figure 30:
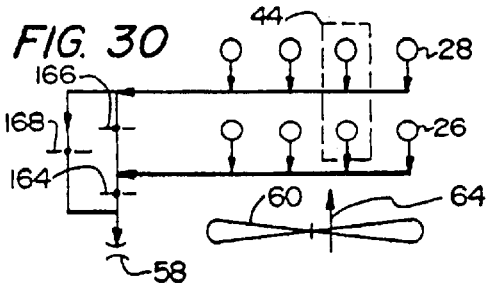
FIG. 30 shows how FIG. 29 can be modified to accommodate bundle airflow reversal by manual means.
Figure 31:
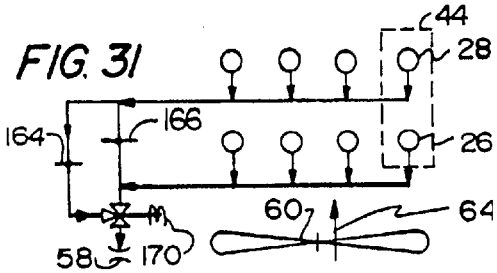
FIG. 31 shows how FIG. 30 can be modified to accommodate bundle airflow reversal by automatic means.

FIGS. 29, 30 and 31 provide only fan cell isolation with its two orifices 164 and 166. FIG. 30 shows how to convert FIG. 29 to allow operation with reverse cooling air flow 66 through the bundles. Orifices 164 and 168 must be manually reversed. Orifice plate 168 is blank with no orifice hole while orifice 164 is full-bore full-flow without restriction. FIG. 31 is the automated version of FIG. 30 which requires a 2-way solenoid valve 170. This valve is energized during cold weather so that the gas/vapors flow through the bypass leg of the piping.

FIGS. 32, 33, 34, 35 and 36 are comparable to FIGS. 27, 28, 29, 30 and 31 except that they are designs for bundles 46 with four rear headers 18, 20, 22 and 24 instead of two.

Figure 32:
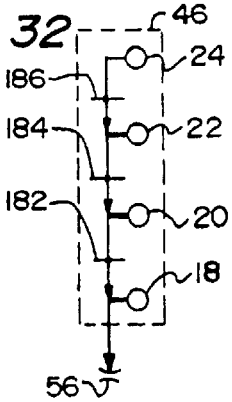
FIG. 32 shows one Direct Withdrawal bundle with four rear headers, series orifices and a single steam ejector providing bundle and fan cell isolation.

FIG. 32 shows one bundle 46 with its individual steam ejector 56. This design represents the highest degree (No. 1) of rear header isolation from gas/vapor backflow. One fan cell 62 would have four such bundles 46 and four steam ejectors 56.

FIG. 33 shows the second highest (No. 2) form of rear header isolation where the four bundles 46 share the same steam ejector 58. All orifices are in series flow. All rear header orifices of the same tube row are the same size.

Figure 34:
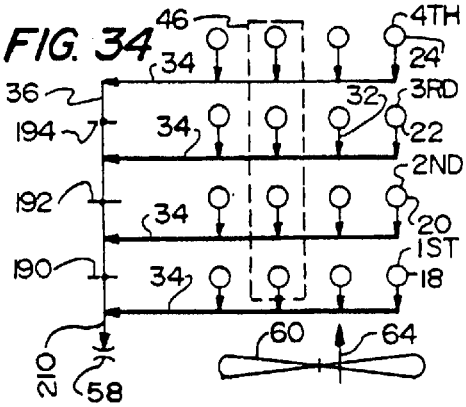
FIG. 34 shows four Direct Withdrawal bundles constituting one fan cell with four rear headers each, series manifold orifices and a single steam ejector providing fan cell isolation only.
Figure 35:
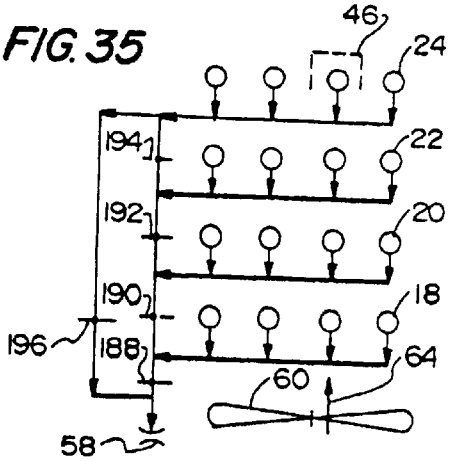
FIG. 35 shows how FIG. 34 can be modified to accommodate bundle airflow reversal by manual means.
Figure 36:
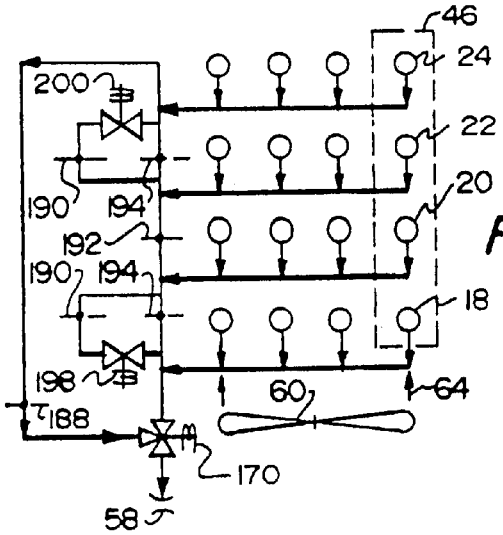
FIG. 36 shows how FIG. 35 can be modified to accommodate bundle airflow reversal by automatic means.

FIGS. 34, 35 and 36 provide only fan cell isolation with its orifices 188, 190, 192 and 194. FIG. 35 shows how to convert FIG. 34 to allow operation with reverse cooling air flow 66 through the bundles. Orifice 196 is blank with no orifice hole. During cold weather operation orifices 188 and 196 and orifices 190 and 194 must be manually rotated. FIG. 36 is the automated version of FIG. 35 which requires three solenoid valves 170, 198 and 200. In normal air flow operation valve 200 is closed, valve 198 is open and 2-way valve 170 is straight-through flow. In reverse air flow valve 200 is open, valve 198 is closed and two-way valve 170 has 90 degree flow through by-pass leg orifice 188.

The many new and varied freeze-protecting rear header isolation designs that are being revealed in this invention are summarized below:

| FIG. | NUMBER REAR HEADERS | ORIFICE CONNECTIONS | DEGREE OF ISOLATION (*) FROM EXTERNAL/INFLUENCES BUNDLE | FAN CELL | BUNDLE AIR FLOW DIRECTION FORWARD ONLY | FORWARD & REVERSE |
|---|---|---|---|---|---|---|
| | | | SPARGER WITHDRAWAL | | | |
| 7 | 2 | PARALLEL | 1 | 1 | X | — |
| 8 | 2 | PARALLEL | 2 | 1 | X | — |
| 9 | 2 | PARALLEL | 2 | 1 | — | MANUAL |
| 10 | 2 | PARALLEL | 2 | 1 | — | AUTO |
| 11 | 4 | PARALLEL | 1 | 1 | X | — |
| 12 | 4 | PARALLEL | 2 | 1 | X | — |
| 13 | 4 | PARALLEL | 2 | 1 | — | MANUAL |
| 14 | 4 | PARALLEL | 2 | 1 | — | AUTO |
| | | | DIRECT WITHDRAWAL | | | |
| 15 | 2 | PARALLEL | 1 | 1 | X | — |
| 16 | 2 | PARALLEL | 2 | 1 | X | — |
| 17 | 2 | PARALLEL | 2 | 1 | — | MANUAL |
| 18 | 2 | PARALLEL | 2 | 1 | — | AUTO |
| 19 | 2 | PARALLEL | 3 | 1 | X | — |
| 20 | 2 | PARALLEL | 3 | 1 | — | MANUAL |
| 21 | 2 | PARALLEL | 3 | 1 | — | AUTO |
| 22 | 4 | PARALLEL | 1 | 1 | X | — |
| 23 | 4 | PARALLEL | 2 | 1 | X | — |
| 24 | 4 | PARALLEL | 3 | 1 | X | — |
| 25 | 4 | PARALLEL | 3 | 1 | — | MANUAL |
| 26 | 4 | PARALLEL | 3 | 1 | — | AUTO |
| 27 | 2 | SERIES | 1 | 1 | X | — |
| 28 | 2 | SERIES | 2 | 1 | X | — |
| 29 | 2 | SERIES | 3 | 1 | X | — |

-continued

| FIG. | NUMBER REAR HEADERS | ORIFICE CONNECTIONS | DEGREE OF ISOLATION (*) FROM EXTERNAL/INFLUENCES BUNDLE | FAN CELL | BUNDLE AIR FLOW DIRECTION FORWARD ONLY | FORWARD & REVERSE |
|---|---|---|---|---|---|---|
| 30 | 2 | SERIES | 3 | 1 | — | MANUAL |
| 31 | 2 | SERIES | 3 | 1 | — | AUTO |
| 32 | 4 | SERIES | 1 | 1 | X | — |
| 33 | 4 | SERIES | 2 | 1 | X | — |
| 34 | 4 | SERIES | 3 | 1 | X | — |
| 35 | 4 | SERIES | 3 | 1 | — | MANUAL |
| 36 | 4 | SERIES | 3 | 1 | — | AUTO |

(*) No. 1 is highest and No. 3 is lowest.

This tabulation only includes bundles with 2 and 4 rear headers, Sparger and Direct Withdrawal designs, parallel and series orifices plus either manual or automatic reverse air-flow capability. The highest degree of bundle isolation is labeled No. 1 in the vertical column shown as was discussed earlier. Each fan cell is completely isolated from all other fan cells.

The Sparger Withdrawal designs, FIGS. 7 through 14 are improvements to three new Air-Cooled Vacuum Steam Condensers, U.S. Pat. Nos. 4,903,491, 4,905,474 and 4,926,931 by the inventor. These same advanced new concepts are being proposed for application to the older and more conventional Direct Withdrawal rear header designs employed in existing air-cooled steam condensers that have either two or four rear headers per bundle. These typical designs are shown in FIG. 15 through 36 and FIG. 40. The same basic concepts would apply to bundle designed with one, three, five, etc. rear headers.

D-Steam Nozzle Requirements

The object sought in this disclosure is to improve the freeze protection features of air-cooled vacuum steam condensers by isolating fan cells and their bundles. This isolation is achieved by the use of orifices and steam ejector means that prevents back-flow of gases/vapors between the bundle rear headers and the common manifold piping system. The preferred installation would have only one steam ejector per fan cell for cost reasons but there are situations where as many as six or more may be required. The reasons that multi steam ejectors may be required for each fan cell are presented below with reference to a sheet of drawings containing FIGS. 22A, 22B, 24, 24A and 40.

Figure 22A:
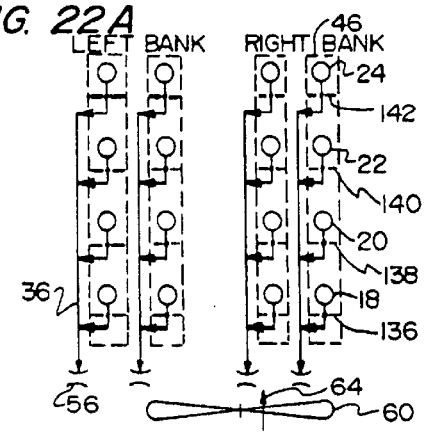
FIG. 22A is similar to FIG. 22 except it shows four bundles constituting one fan cell.

FIG. 22A shows a divided rear-hearder, four bundle 46, fan cell with two bundles in the left bank of the condenser and two in the right bank as shown in FIG. 37A. This is the orifice/steam ejector design shown in FIG. 22 except it is now shown as one fan cell with four steam ejectors 56. This design gives the highest degree of isolation (No. 1) to both the individual bundles and the fan cell.

Figure 22B:
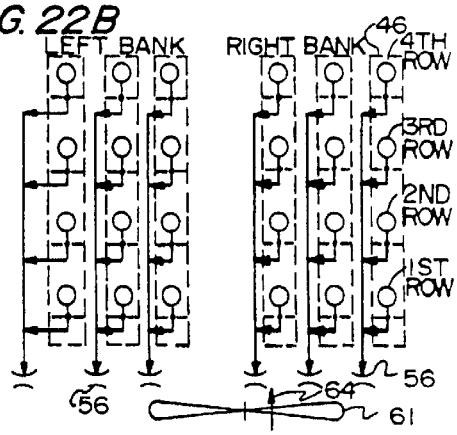
FIG. 22B is similar to FIG. 22 except it shows six bundles constituting one fan cell.

FIG. 22B is similar to FIG. 22A except that it has six bundles 46 per fan cell and a total of six steam ejectors 56. The number of bundles used in a fan cell depends on the diameter of the fan selected for the job.

Figure 24A:
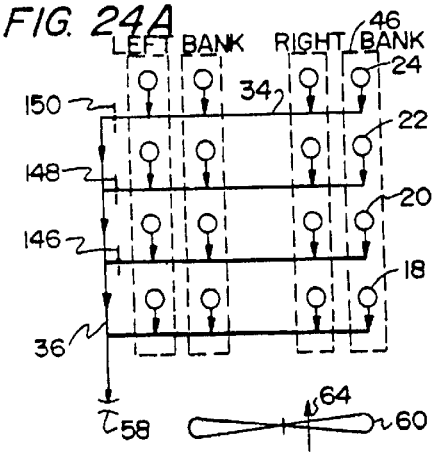

FIGS. 24 and 24A show a divided rear-header, four bundle 46, fan cell with two bundles in the left bank of the condenser and two in the right bank. Only one steam ejector 56 is required. This design is the lowest cost and provides the least isolation (No. 3) to the bundles from external/internal influences.

FIGS. 24 and 24A can also be applied to a gas/vapor evacuation system serving the entire steam condensing plant instead of just one fan cell. The SJAE set would have just one large 1st stage steam ejector and three orifice plates.

Figure 24B:
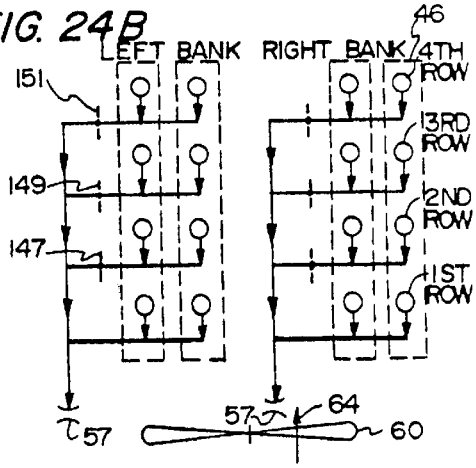
FIG. 24B is similar to FIGS. 24 and 24A except it shows two steam ejectors. One ejector serves the left bank of bundles and the other the right bank of one fan cell.

FIG. 24B shows a four bundle 46 fan cell with two bundles in the left bank of the condenser and two in the right bank similar to FIG. 24. However, each bank of bundles has its own steam ejector 57 thereby making each bank independent. The reason for wanting this design is that a high velocity cold wind blowing from left to right FIG. 37A would cause the left bank bundles to condense more steam than the right bank. This could cause a major upset in rear header steam pressures that would cause backflow of gas/vapors from the right bank to the left bank. Installing two steam ejectors 57 per fan cell solves this problem.

Figure 24C:
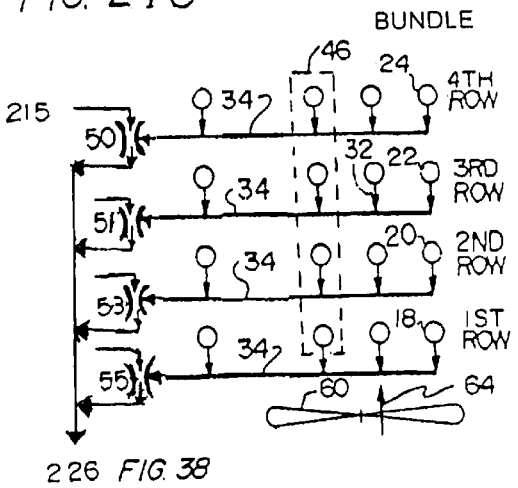
FIG. 24C is similar to FIG. 24 except that the orifices have been replaced with steam ejectors. This change would also apply to FIGS. 5, 9, 10, 13, 14, 15, 16, 17, 18, 19, 20, 21, 22, 22A, 22B, 24, 24A, 24B, 25, 26, 29, 30, 31, 38, 39, and 40.

FIG. 24C is an alternative design variation of FIG. 24 that replaces orifices 146, 148, 150 and steam ejector 58 with four (4) small steam ejectors 50, 51, 53 and 55. The steam condenser designer has the choice of using either orifices or steam ejectors as they both provide mass flow control and the sought isolation of the tube rows and their bundles from dangerous gas/vapor interchange back flows. The steam ejectors, however, are higher cost but they provide wider range operating stability which is necessary for low load and low ambient temperature conditions. Knowing the operating parameters and cost limits of the particular installation under consideration, the condenser designer chooses either the lower cost orifices or the wide range steam ejector design accordingly.

FIG. 40 show a four tube-row, four bundle 48, fan cell with one steam ejector 58. This is a design which has only one rear header, either 18 or 19, per bundle serving all its tube rows. The steam pressure differences between rows are balanced out internally so that external orifices such as 146, 148 and 150 FIG. 24 are not required in its gas/vapor piping system.

E-Air-Cooled Intercondensers

Figure 38:
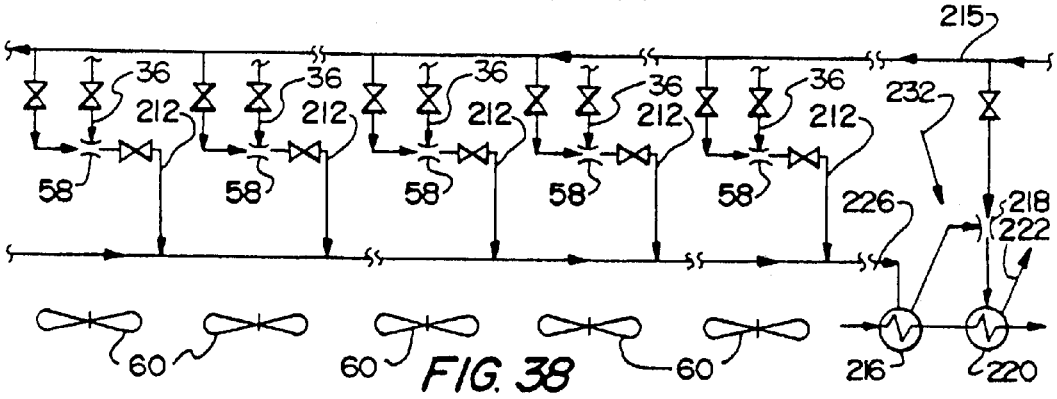
FIG. 38 shows the remainder of the noncondensible gas removal system starting at the steam ejectors located at each fan cell and ending with the nondondensible gasses being discharged to atmosphere.

What has been discussed up to this point are the many varied ways that the noncondensible gas piping system inside one fan cell can be designed. FIGS. 38 and 39 show the remainder of this piping system and the final discharge of the gases to atmophere 222 from the steam condensing system.

FIG. 38 shows one steam ejector 58 per fan cell removing all of the noncondensible gas/vapors 210 from its cell. Each ejector is tied into a steam supply piping manifold system 215 carrying motive steam while its exhaust is tied into another piping manifold system 226 that carries the gas/vapors to the plant's Steam-Jet-Air-Ejection (SJAE) set 232. The steam/vapor mixture is partially condensed in the water-cooled intercondenser 216. The remainder of the gas/vapors are withdrawn from the shell of the intercondenser by the 2nd stage steam ejector 218 and discharged into the shell of after-condenser 220. The steam vapors condense while the air and gases are discharged to the atmosphere 222.

FIG. 39 shows how a new finned air-cooled heat-exchange manifold 228 can be substituted for conventional pipe 226 carrying the steam/gas/vapors to the ejector set. This low-cost air-cooled steam condenser installed on the discharge side of the 1st stage steam ejectors would eliminate the need for the costly water-cooled intercondenser (216). Item 224 is a condensate/vapor separator with the condensate 230 flowing down to the condensate storage tank while the gas/vapors flow up direct to the 2nd stage steam ejector 218.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. A multi fan-cell system for condensing steam vapors contaminated with air and gases, the system being isolated into single fan cells for the removal and discharge of its non-condensable gas/vapors, each fan cell having one fan and a predetermined number of steam condensing bundles which includes a front header, finned tubes arranged in a plurality of stacked and tubular rows and rear header means whose gas/vapors are extracted and isolated from all other fan cells by a vacuum-producing ejector for each row of each fan cell directly coupled to the rear header means by pipe and manifold means all located and installed within the confines of the fan cell they serve.

2. The system as set forth in claim 1 and further including means for driving the fan in operative association with each cell to force ambient air flow across the finned tubes to thereby condense the steam inside the tubes.

3. The system as set forth in claim 2 and further including means to reverse the direction of the air flow through the bundle by reversing the direction of the fan rotation.

4. The system as set forth in claim 2 and further including means to reverse the direction of the air flow through the bundle by changing the fan blade pitch.

5. The system as set forth in claim 1 wherein the bundles have a plurality of rear header headers with a plurality of steam pressures that require individual gas/vapor evacuation, and orifice-type restrictions means installed in the pipe and manifold means for the mass flow control of gas/vapors leaving the rear headers and entering the ejector and for the isolation of the bundles and tube rows from gas/vapor interchange.

6. The system as set forth in claim 5 wherein the orifice restriction means is manually changeable between tube rows thereby allowing the bundles of fan cells to operate with ambient air flow in reverse direction.

7. The system as set forth in claim 6 wherein the restriction means are automatically changeable to allow the bundles to operate in reverse direction ambient air flow.

8. The system as set forth in claim 5 wherein the restriction means can be changed manually to different sizes between warm weather orifices and cold weather orifices as required to allow proper bundle functioning with reverse direction ambient air flow across all the bundles of a fan cell.

9. The system as set forth in claim 8 wherein the restriction means size changes are made automatically.

10. The system as set forth in claim 8 wherein one restriction means serves one rear header.

11. The system as set forth in claim 8 wherein one restriction means serves all the rear headers in the fan cell that are of the same tube row number.

12. The system as set forth in claim 8 wherein the restriction means are different size orifice holes to accommodate different steam pressures and different flow rates.

13. The system as set forth in claim 5 wherein the restriction means are holes drilled in a suction sparger pipe installed inside each rear header.

14. The system as set forth in claim 5 wherein the orifices are parallel-connected orifices in a first pipe means.

15. The system as set forth in claim 5 wherein the orifices are parallel-connected orifices installed in a first pipe means plus series-connected orifices installed in primary manifolds.

16. The system as set forth in claim 5 wherein the orifices are parallel-connected orifices installed in primary manifolds whereby the gas/vapor discharges from rear headers of the same row of tubes are coupled together but different rows of tubes are isolated from each other.

17. The system as set forth in claim 5 wherein the orifices are series-connected orifices installed in a secondary manifold whereby gas/vapor discharges from the same row of tubes are coupled together but different rows of tubes are isolated from each other.

18. The system as set forth in claim 5 wherein the orifices are series-connected orifices installed in primary manifolds such that one primary manifold serves one bundle whereby the gas/vapor discharges from the rear headers of any one bundle are isolated from each other.

19. The system as set forth in claim 5 is modifies by installing steam ejectors for mass flow control and isolation of the gas/vapors leaving the bundle rear headers in the pipe and manifold means, in place of the orifice type devices.

* * * * *